US006216598B1

(12) United States Patent
Godfrey Phillips

(10) Patent No.: US 6,216,598 B1
(45) Date of Patent: Apr. 17, 2001

(54) LOW TOXICITY SHOT PELLETS

(75) Inventor: Arthur H. Godfrey Phillips, Tonbridge (GB)

(73) Assignee: The Kent Cartridge Manufacturing Company Limited, Kent (GB)

( * ) Notice: Subject to any disclaimer, the term of this patent is extended or adjusted under 35 U.S.C. 154(b) by 0 days.

(21) Appl. No.: 09/492,045

(22) Filed: Jan. 26, 2000

Related U.S. Application Data

(63) Continuation of application No. 08/766,561, filed on Dec. 13, 1996, now abandoned.

(30) Foreign Application Priority Data

Dec. 15, 1995 (GB) ..... 9525619
Aug. 19, 1996 (GB) ..... 9617878

(51) Int. Cl.[7] ..... F42B 12/74
(52) U.S. Cl. ..... 102/507
(58) Field of Search ..... 102/517; 419/65

(56) References Cited

U.S. PATENT DOCUMENTS 5,159,007 * 10/1992 Saitoh et al. ..... 524/439
5,399,187 * 3/1995 Mravic et al. ..... 75/228
5,719,352 * 2/1998 Griffin ..... 102/517
5,760,331 * 6/1998 Lowden et al. ..... 102/506
5,950,064 * 9/1999 Robinson et al. ..... 419/47
6,048,379 * 4/2000 Bray et al. ..... 75/229

* cited by examiner

*Primary Examiner*—Daniel J. Jenkins
(74) *Attorney, Agent, or Firm*—Arnold B. Silverman; David C. Jenkins; Debra Z. Anderson

(57) ABSTRACT

Shot for shotgun cartridges is made form finely divided particles of dense metal such as a mixture of tungsten and molybdenum, bound by a matrix which may comprise ethylene propylene copolymer, or a blend of a terpolymer of ethylene, acrylic ester and maleic anhydride or an ionomer either alone or blended with such terpolymer or with a stock polymer material or a blend of polymers. Shot may be produced from such material by forming it into a strip, web or strand which is passed between aligned rollers with cooperating hemispherical indentations and thereafter punching the resulting shot from the resulting thin web.

31 Claims, No Drawings

LOW TOXICITY SHOT PELLETS

This application is a continuation of U.S. Ser. No. 08/766,561, filed on Dec. 13, 1996, now abandoned.

BACKGROUND OF THE INVENTION

Field of the Invention

THIS INVENTION relates to shot pellets and the like.

A Many thousands of tonnes of lead shotgun pellets are scattered on the surface of the earth and embedded in trees each year in the act of vermin, game and clay target shooting for both pleasure and vermin control purposes It is now recognized that where this falls on wetlands it may be accidentally ingested by wildfowl together with their normal grit diet deliberately consumed as an essential part of their gizzard digestive process. The outcome is that the lead is ground up by the gizzard resulting in poisoning, debilitation and death. A further problem now recognized is that lead shot deposited on land where crops are grown can be dissolved and enter into the structure of the crop which is designed for human consumption.

A similar problem of wildfowl poisoning caused by the lead weights used by fishermen has been resolved by the adoption of alternative heavy materials for the weights. Attempts to apply a similar solution to the lead shot used in shotgun cartridges have proved much more difficult because of the stringent requirements imposed by the need for effective ballistics, safe performance and the economics related to the precious nature of many heavy metals. A shotgun shot must have the correct physical properties that allow it to provide correct ballistics and yet allow it to pass safely through a shotgun barrel at very high pressure without risking safety related to the proof of the gun.

One key property of lead that makes it so successful as a shot material is its high density, 11.35 tonnes per $m^3$, because the energy associated with the shot at the moment it strikes the target relates to its mass and its velocity as $E=\frac{1}{2}mv^2$. A second property of lead is its softness allowing it to pass through a gun barrel safely and without causing damage to the barrel structure despite high pressure and velocity. A third property is the ability of lead spheres to flatten slightly and retain the flattened shape thereby showing no elastic tendency. This enables the energy contained within the mass of the sphere to be transferred to the target with maximum lethal effect.

Lead has a modest position in the list of abundances of the metallic elements at 10 parts per million and poses no problem of dwindling resource.

Iron has been proposed as an alternative and has found some use but its density is only 7.86 tonnes per $m^3$ which means it only carries 69.25% of the striking energy provided by lead shot of the same size. Iron shot also offers problems because of its hardness and rigidity, which causes damage to the steel gun barrel bores of the modern shotgun, and has a tendency to create abnormally high and dangerous pressures. Iron based shot has a tendency to corrode so that the individual shot spheres bind together producing a dangerous solid slug which can destroy the gun barrel. Iron based shot can become embedded in growing timber and poses a dangerous threat to timber processing machinery and the elasticity of iron and steel results in shot that ricochets dangerously and does not transmit its energy to the target in an effective and lethal manner resulting in wounding of live targets.

Bismuth has also been proposed as an alternative and has found some use. The density is 9.747 tonnes per $m^3$ and is approaching lead but its abundance is only 0.004 parts per million and it is a secondary metallurgical material being a by-product of the refining of other metals. The price is high and the source precarious which means any attempt to adopt it generally would result in prohibitive price escalation. Bismuth is a very brittle metal and can only be made more usable if it is alloyed with expensive tin or toxic lead. There are also unresolved questions about its toxicity when ingested by animals and humans.

It has been proposed to use tungsten, tungsten alloys or mixes of tungsten and other metals such as molybdenum as fillers in plastics matrices of various kinds as a basis for an alternative shot material, for example as exemplified in GB-A-2200976 and W094/24511. However, it has been found that known substitute shot materials are inferior to lead as a shot material in various respects. Indeed, some previous attempts to produce substitutes for lead shotgun shot have proved disastrous because the shot has either tended to shatter or has tended to stick together and has caused damage to gun barrels because the formulations used have included-polymers that cannot form a proper matrix and because the mixture used was abrasive.

Experiments conducted by the applicants suggest that, apart from density, the deformability of the shot material is also important. That is to say, that experiments suggest that both (a) resilience, i.e. recoverable deformability and (b) the ability to deform permanently (at least in the short term) on striking the target, are important. Thus, shot which is substantially rigid tends to lack "stopping power" for shooting game, in that such shot tends to pass through the game with significantly less transfer of energy to the game than would corresponding lead shot and thus tends to wound, rather than kill, the game. On the other hand, shot which is too readily deformable, and, in particular, which too readily undergoes a permanent deformation, produces too open a pattern at typical target distances. The applicants hypothesize that this is due to such shot becoming flattened by the acceleration imparted to it when the gun is fired, so that the individual shot are no longer spherical and are deflected slightly, and randomly, by aerodynamic forces. Furthermore, shot which is too readily flattened on striking a target again tends to wound, rather than kill, game because penetration is insufficient since, presumably, too much energy has been lost by excessive flattening of the shot and/or such energy has been spread over a larger frontal area of the target.

It is an object of the present invention to provide an improved alternative shot material without the disadvantages of toxicity, elasticity, brittleness and high price whilst possessing the qualities of high density, softness and an ability to transmit to target the striking energy resulting in effective lethality.

According to one aspect of the invention, there is provided shot for shotgun cartridges comprising finely divided metallic particles in a polymer matrix comprising:

(a) polypropylene or polypropylene copolymer and (b) a terpolymer of acrylic ester, ethylene and maleic anhydride.

According to another aspect of the invention there is provided shot for shotgun cartridges comprising finely divided metallic particles in a polymer matrix comprising ethylene propylene copolymer.

Said polymer mix may also include polyisobutylene.

Preferably said polymer matrix comprises a major proportion of polypropylene.

According to another aspect of the invention, there is provided a mouldable thermoplastic composition, suitable for making shot for shotgun cartridges, the composition comprising finely divided metallic particles in a polymer matrix comprising a blend of polymers.

Preferably, the metallic particles comprise materials selected from the group comprising iron, tungsten, molybdenum, alloys of tungsten or molybdenum with other metals or mixtures of such materials.

The metallic particles may comprise a mixture of tungsten or a tungsten alloy with molybdenum or a molybdenum alloy.

The blend of polymers preferably comprises a blend of a polyolefinic polymer, a styrene based polymer and a polymer containing maleic anhydride.

The polyolefinic polymer may be one selected from the group comprising LDPE (low density polyethylene), LLDPE (linear low density polyethylene), EVA (ethylene vinyl acetate copolymer), EEA (ethylene ethyl acrylate copolymer), ionomers (copolymers of alkenes and alkacrylic acids with metal ion crosslinks), polybutene, poly (4methylpent-1-ene), PP (polypropylene) homopolymer, or PP (polypropylene) copolymer, or mixtures thereof, said polyolefinic polymer comprising from 50% to 90% by weight of the composition.

The styrene-based polymer may be selected from the group comprising polystyrene, HIPS (high impact polystyrene), SAN (styrene acrylonitrile polymer), ABS (acrylonitrile butadiene styrene terpolymer) or a polystyrene/polyphenylene oxide blend, such as the blend of poly-2, 6-dimethyl-p-phenylene oxide and polystyrene or a polystyrene-related material, sold by General Electric under the Trade Mark NORYL.

According to another aspect of the invention there is provided a method of manufacturing shot for shotgun cartridges including mixing finely divided metal particles with a molten thermoplastics polymer, forming the resultant mixture into a plastics strip, web or strand, passing said strip, web or strand between two aligned rollers with cooperating hemispherical indentations to produce, on the exit side of said roller, a strip comprising a series of substantially spherical bodies connected and separated by a relatively thin web of the plastics material, subsequently placing said web between a first tool provided with apertures of a size to receive said spherical bodies and a second tool, such that said web overlies said first tool and said spherical bodies are seated in said apertures in the first tool, and pushing the spherical bodies through said recesses by means of said second tool, thereby punching the spherical bodies from the web with a minimum of equatorial "flash" or other discontinuities. Thus the action of said further rollers is to separate said spherical bodies from said web around peripheral lines of separation close to the peripheries of said spherical bodies. Said first and second tool may also comprise cooperating rollers, which may receive said strip from the first-mentioned rollers and may be driven in synchronism therewith.

The finely divided metallic particles may comprise tungsten, a mixture of molybdenum and tungsten, or a tungsten alloy such as ferro-tungsten, which has been found to have favorable properties, although it is of lower density than tungsten.

According to a still further aspect of the invention, there is provided a method of manufacturing shot for shotgun cartridges including mixing finely divided metallic particles in a polymer matrix comprising a blend of propylene or propylene polymers, to form a composition as described above forming the resultant mixture into a formable plastic web, passing said web between aligned rollers and thereby producing, directly or indirectly, substantially spherical bodies with equatorial flash therearound, and thereafter tumbling said bodies in a heated drum to remove such flash from the bodies.

The invention proposes a form of composite shot in which powdered metal, for example a mixture of powdered molybdenum and tungsten, is bound into a solid pellet by the use of polymeric materials. Preferably the material is present in just sufficient quantity to fill, or almost fill, the voids between the particles of the powdered metal such that the mix is close to the condition of close packing of spheres which means that about two thirds of the volume is metal powder. This, at 70% by volume in a binder matrix of unit density, molybdenum alone would give a pellet of density about 7.51 tonnes per $m^3$. If only 23% of the metal in the mix is replaced by powdered tungsten then a pellet of density 8.42 tonnes per $m^3$ is created which would have 13.63% more striking energy than an iron pellet and yet would be compliant because of the nature of the polymeric binder.

Alternatively, a powdered tungsten alloy, such as ferro-tungsten, may be used as the metal filler.

It is further proposed to include in the polymer/metal mix minor amounts of a lubricant substance such as molybdenum sulphide or graphite which would further improve the performance and minimize the wear of the gun barrels. Waxes and oils may be included in the mix to aid blending and flow in manufacture.

The preferred polymeric binder or matrix comprises (a) polypropylene or polypropylene copolymer (that is to say a copolymer of propylene and ethylene in which the ethylene content is relatively small, for example around 4%) and (b) a terpolymer of acrylic ester ethylene and maleic anhydrides. The component (b) may be the material supplied by Elf Atochem under the name "Lotarder".

A less preferred polymeric binder comprises a blend of ethylene propylene copolymer and polyisobutylene.

Embodiments of the invention are described below by way of example.

EXAMPLE 1

A technical grade of powdered molybdenum with an average particle size of 45 micrometers was blended with commercially purchased tungsten powder with an average particle size of 20 micrometers in the ratio of 43.08% by weight of tungsten and 56.92% by weight of molybdenum. This blend of powdered metals was then blended with a plastics matrix comprising 90 per cent by weight of the matrix of ethylene propylene copolymer having an ethylene content of 40 to 50% with a broad molecular weight distribution and a Mooney Viscosity ML (1+4) 125° of 25 to 30 and a density of around 1 tonne/$m^3$, and 10 per cent by weight of polyisobutylene having a Viscosity Average Molecular Weight of 750000 to 1500000. This was plasticised by the addition of 5 to 10% by weight of mineral oil.

The resultant mass was compounded using a sigma blade mixer and was formed into a web by calendering and fed, at a temperature at which the web was still plastic, between two aligned driven steel rollers with 3mm diameter hemispherical indentations in each roller, the arrangement being such that respective indentations in the two rollers come into register with one another in the nip of the roller, the spacing between the un-recessed portions of the cooperating roller surfaces being of the order of 0.1 mm. The resulting product, by either method, is a web with 3 mm spheres separated by webbing of 0.1 mm thickness. In a variant, the plastics matrix is extruded using a screw extruder at 200° C. into a continuous rod or wire, which was fed, whilst still plastic, between two such cooperating rollers as described. This web, with the spheres, was, after cooling and hardening, fed between two further cooperating aligned rollers, one having apertures of slightly more than 3 mm diameter to receive said 3 mm spheres and the other having a plain circumference, or having projections corresponding to said apertures, such that as the web is passed between said further rollers, said spherical bodies are seated in said apertures and are pushed out of the web and through said apertures by the unapertured roller, to be collected for incorporation into cartridges, possibly after further processing. such further processing may comprise removal of any remaining flash from the spherical particles by tumbling in a metal drum heated to around 180° C.

EXAMPLE 2

The procedure described in Example 1 was followed, using as the plastics matrix, a blend of polypropylene copolymer with a terpolymer of acrylic ester, ethylene and maleic anhydride, such as sold by Elf Atochem under the name "Lotarder", the terpolyrner forming 10% of the plastics blend. Waxes and oils were included in the mix to aid blending and flow in manufacture.

The resulting shot was found to be significantly superior in performance, producing optimum shot patterns and "spread" in ballistics tests and improved lethality against game. Surprisingly range was found to be improved as compared with corresponding lead shot.

EXAMPLE 3

The procedure described in Examples 1 and 2 was followed, using, as the plastics matrix, a blend of polymers having the following composition:

| | |
|---|---|
| Polystyrene | 30% by weight of the composition |
| Ethylene propylene copolymer | 40% by weight of the composition |
| LOTARDER-terpolymer of acrylic ester, ethylene and maleic anhydride | 30% by weight of the composition |

Minor proportions of waxes and oils may again be included in the mix to aid blending and flow in manufacture. Alternatively or additionally, minor proportions of lubricants and processing aids such as metal soaps may be incorporated and/or antioxidants.

It has been found that shot manufactured as described in Example 3 above has much improved properties as compared with that made in accordance with Examples 1 and 2 above. However, acceptable shot can be produced with polymer blends having compositions within the following ranges.

| | |
|---|---|
| Polystyrene | 10% to 50% by weight |
| LOTARDER-terpolymer | 5% to 40% by weight |

with ethylene propylene copolymer making up the balance.

ABS may also be used, with advantage, as a substitute for some or all of the polystyrene in the above formulations.

Whilst styrene based polymers are not normally compatible with polypropylene or polyethylene, the inventor has found that a polymer incorporating maleic anhydride renders these compounds compatible in a blend of the same thereby allowing hitherto unknown and unused blends, such as that of Example 3 above. The shot produced from the polymer matrix of Example 3 was much harder than that of Examples 1 and 2, but still retained the desirable malleability and density of the shot of Examples 1 and 2, thereby ensuring an excellent transfer of energy to the target. At the same time, the increased hardness of shot made in accordance with Example 3 has been found not to render it so brittle that the shot pellets disintegrate from impact with one another or with the gun barrel. It has been found, as a result, that by using shot manufactured in accordance with Example 3, the shot pattern can be made much more dense than formerly, resulting in greater total striking energy, without loss of lethality of the individual pellets. Such loss of lethality occurs in substitute shot of the prior art because of disintegration of the shot pellets or distortion of the shot pellets from their nominally spherical shape prior to impact with the target.

In place of the ethylene/acrylic ester/maleic anhydride terpolymer referred to above, there may be used a maleic anhydride grafted polyolefin such as that available from DuPont under the Trade Mark FUSABOND. When such a grafted polyolefin is used it may be used in a proportion of from 3% to 30% by weight of the polymer blend.

EXAMPLE 4

The procedure described in Example 3 was followed, except that there was substituted, for the ethylene propylene copolymer, an ethylene/methacrylic ionomer. (As is known, an ionomer is the product of ionic bonding action between long chain molecules). Although it is not intended thereby to limit the scope of the invention in any respect, the preferred ethylene/methacrylic ionomer may be prepared by polymerising ethylene with 1 to 10% by weight of methacrylic acid using a high pressure process. The polymer is then treated with a metal derivative such as sodium methoxide, whereby some of the carboxyl groups are converted to the sodium salt. The ionic cross links give enhanced stiffness and toughness. The method described of making the ionomer is known and is summarised above merely for purposes of identification of the material.

The resulting material has many physical properties substantially the same as polyethylene but has a greater oil-resistance and (of more significance in the present context) a lower softening point or region. Thus, the sodium cross links are stable at room temperature but loosen or break down as the temperature of the material is raised, but become re-established when the material is cooled down again. The material resulting from the process of Example 4 can be processed, e.g. by extrusion or calendering, at normal temperatures, for example in the range 150° C.–200° C. When cold, the material has a consistency and hardness similar to that of lead and can, for example, be cut by a knife but the material is tough and not subject to shattering, (unlike, for example, shot made by an analogous process using polystyrene). On the other hand, the composite material produced is without significant abrasive effect upon the material of shotgun barrels, so that shot made from such material does not tend to damage the bore of shotguns, (a fault of some forms of lead-substitute shot which have been proposed in the past and which fault is particularly pronounced in relation to shotgun bores having a significant "choke").

It should be understood that the ionomer referred to above is not a polymer in the sense in which that word is normally used and is certainly not a standard plastics material. In particular, the applicants do not believe that it has ever been proposed or suggested to use such ionomer material as a binder for metallic powder or particles for the manufacture of shot or other projectiles, or that the properties of such ionomer material which make it particularly suited to such use have previously been fully appreciated.

In a further variant, both the polystyrene component and ethylene propylene copolymer component of Example 3 may be replaced by the ethylene/methacrylic ionomer discussed above. Indeed, the material used to form the lead-free shot may comprise, as its plastic component, solely ethylene methacrylic ionomer, although a blend of such ionomer with the LOTARDER terpolymer of acrylic ester, ethylene and maleic anhydride is preferred.

Furthermore, other ionomers may be used in this context, for example an ethylene methacrylic ionomer with zinc or lithium for the ionic cross-links instead of sodium.

Other ionomers than that specifically mentioned above may be utilised, e.g. propylene methacrylic ionomer, ethylene or propylene ethacrylic ionomers and so on, either alone or in combination with other ionomers or with polymers.

In general other alkene alkacrylic ionomers may be useful in carrying out the invention, alone or in combination with other materials, as a binder for the metallic powder.

The pellets manufactured as described in Example 1, Example 2, Example 3 or Example 4 above may be incorporated in a shotgun cartridge in which the propellent is retained within a casing by a wad made of fibre or plastic above which a number of near spherical shot pellets are situated, the pellets being retained by crimping the extremity of the casing or by some other readily releasable closure means, such as a further wad for example in the form of a cardboard or plastic disc.

What is claimed is:

1. Shot for shotgun cartridges comprising finely divided metallic particles in a matrix comprising ethylene methacrylic ionomer.

2. Shot according to claim 1 wherein said metallic particles comprise tungsten, a tungsten alloy or a mixture of tungsten and another metal.

3. Shot according to claim 1 wherein said metallic particles comprise ferro-tungsten alloy.

4. Shot according to claim 1 wherein said metallic particles comprise tungsten particles and molybdenum particles.

5. A shotgun cartridge including propellant retained within a casing and shot retained in the casing, the shot being in accordance with claim 1.

6. Shot according to claim 1 wherein said ionomer is an ionomer with zinc or lithium cross-links.

7. Shot according to claim 1 wherein said ionomer is an ionomer with sodium cross-links.

8. Shot for shotgun cartridges comprising finely divided metallic particles in a matrix comprising an ionomer.

9. Shot according of claim 8 wherein said ionomer is an ionomer with sodium cross-links.

10. Shot according to claims 8 wherein said ionomer is an ionomer with zinc or lithium cross-links.

11. Shot according to claim 8 wherein said ionomer is selected from the group consisting ethylene methacrylic ionomer, propylene methacrylic ionomer, ethylene ethacrylic ionomer and propylene ethacrylic ionomer.

12. Shot according to claim 11 wherein said ionomer is an ionomer with sodium cross-links.

13. Shot according to claim 11 wherein said ionomer is an ionomer with zinc or lithium cross-links.

14. Shot according to claim 13 wherein said ionomer comprises an alkene alkacrylic ionomer.

15. Shot according to claim 14 wherein said ionomer is an ionomer with sodium cross-links.

16. Shot according to claims 14 wherein said ionomer is an ionomer with zinc or lithium cross-links.

17. Shot according to claim 13 wherein said matrix comprises a blend of a polymer with an ionomer.

18. Shot according to claim 17 wherein said ionomer is an ionomer with sodium cross-links.

19. Shot according to claim 18 wherein said ionomer is an ionomer with zinc or lithium cross-links.

20. Shot according to claim 17 wherein said ionomer is selected from the group consisting ethylene methacrylic ionomer, propylene methacrylic ionomer, ethylene ethacrylic ionomer and propylene ethyacrylic ionomer.

21. Shot according to claim 20 wherein said ionomer is an ionomer with sodium cross-links.

22. Shot according to claim 20 wherein said ionomer is an ionomer with zinc or lithium cross-links.

23. Shot according to claim 17 wherein said ionomer comprises an alkene alkacrylic ionomer.

24. Shot according to claim 23 wherein said ionomer is an ionomer with sodium cross-links.

25. Shot according to claim 23 wherein said ionomer is an ionomer with zinc or lithium cross-links.

26. Shot according to claim 17 wherein said ionomer is an ethylene methacrylic ionomer.

27. Shot according to claim 26 wherein said ionomer is an ionomer with sodium cross-links.

28. Shot according to claims 26 wherein said ionomer is an ionomer with zinc or lithium cross-links.

29. Shot according to claim 8 wherein a blend of ionomers are selected from the group consisting ethylene methacrylic ionomer, propylene methacrylic ionomer, ethylene ethacrylic ionomer and propylene ethyacrylic ionomer.

30. Shot according of claim 29 wherein said blend of ionomers has an ionomer with sodium cross-links.

31. Shot according to claims 29 wherein said blend of ionomers has an ionomer with zinc or lithium cross-links.

* * * * *

UNITED STATES PATENT AND TRADEMARK OFFICE

CERTIFICATE OF CORRECTION

PATENT NO. : 6,216,598 B1
DATED : April 17, 2001
INVENTOR(S) : Arthur H. Godfrey Phillips It is certified that error appears in the above-identified patent and that said Letters Patent is hereby corrected as shown below:

Title page,
Foreign Application Priority Data, "[52] U.S. Class....102/507", should read -- [52] U.S. Class.....102/517 --.

Column 8,
Lines 1 and 49, remove "of", insert -- to --.
Lines 3, 17 & 51, "claims" should read -- claim --.
Lines 6, 26 and 46, insert -- of -- after "consisting".

Signed and Sealed this

Seventh Day of May, 2002

*Attest:*

*Attesting Officer*

JAMES E. ROGAN
*Director of the United States Patent and Trademark Office*